US005802695A

United States Patent [19]

Willoughby

[11] Patent Number: 5,802,695

[45] Date of Patent: Sep. 8, 1998

[54] BELT-MOUNTED TAPE DISPENSER METHOD

[75] Inventor: Billy Dennis Willoughby, Cedar City, Utah

[73] Assignee: W.E. III Tech., Inc., Cedar City, Utah

[21] Appl. No.: 842,742

[22] Filed: Apr. 16, 1997

Related U.S. Application Data

[62] Division of Ser. No. 341,763, Nov. 18, 1994, Pat. No. 5,641,109.

[51] Int. Cl.[6] ..... B26F 3/02

[52] U.S. Cl. ..... 29/434; 225/1

[58] Field of Search ..... 225/19, 20, 56, 225/66, 77, 78, 1; 224/162, 267, 269, 222, 252, 255, 678; 242/404.1, 588.1, 597.8; 29/434

[56] References Cited

U.S. PATENT DOCUMENTS

| | | | |
|---|---|---|---|
| 790,709 | 5/1905 | Villinger et al. . | |
| 1,994,171 | 3/1935 | Denison | 224/162 |
| 2,324,349 | 7/1943 | Atkins | 225/20 |
| 2,352,445 | 6/1944 | Pinckney | 225/20 |
| 2,470,250 | 5/1949 | Kienle | 225/20 |
| 2,963,208 | 12/1960 | Yates et al. | 225/78 |
| 3,125,264 | 3/1964 | English, Jr. | 225/78 |
| 3,140,805 | 7/1964 | Seror | 225/66 |
| 3,217,955 | 11/1965 | Tinkey | 225/78 X |
| 3,502,252 | 3/1970 | Mariani | 225/33 |
| 3,508,692 | 4/1970 | Holtan | 225/7 |

*Primary Examiner*—Eugenia Jones
*Attorney, Agent, or Firm*—J. Winslow Young

[57] ABSTRACT

A belt-mountable tape dispenser operable with one hand for the retrieval and cutting of a predetermined length of tape from a spool of tape mounted to the dispenser. The tape dispenser includes a frame fabricated from a malleable material to accommodate conforming the frame to the waist of the wearer. Belt clips on each end of the frame releasably mount the frame to the belt. A strut extends downwardly from the frame and rotatably supports a reel upon which the spool of tape can be mounted. A cutter assembly and a cutter shield are removably attached to the strut. The cutter assembly and the cutter shield are adaptable to being mounted to the strut for either a left-hand operation or a right-hand operation. The placement of the reel below the frame prevents the pulling and tearing forces imposed on the tape from dislodging the tape dispenser from the belt.

4 Claims, 2 Drawing Sheets

BELT-MOUNTED TAPE DISPENSER METHOD

RELATED APPLICATIONS

This application is a Divisional application of my application Ser. No. 08/341,763 filed 18 Nov. 1994 for BELT-MOUNTED TAPE DISPENSER APPARATUS AND METHOD and now U.S. Pat. No. 5,641,109.

BACKGROUND

Field of the Invention

This invention relates to tape dispensers and, more particularly, to a novel tape dispenser apparatus and method, the tape dispenser being removably mountable to a belt and adapted for single-handed operation to enable the user to retrieve a predetermined length of tape.

Disclosure Document

This patent application is based on the invention disclosed in Disclosure Document No. 335,165 filed 12 July 1993.

The Prior Art

Tape dispensers, per se, are well known in the art and range from the simple to the complex. One common tape dispenser is the stationary tape holder from which one is able to pull a predetermined length of tape prior to selectively severing the tape at that predetermined length. Another well-known tape dispenser is used for sealing packages and involves a roll of tape mounted to a carrier having a handle extending therefrom. The end of the tape is adhesively secured to the package and the dispenser is pulled across the package to dispense a length of tape on the package. The handle of the dispenser is then arcuately rotated to press a cutter against the tape to sever the tape.

Other prior art tape dispensers range from the simple tape holder of Villinger et al. (U.S. Pat. No. 790,709) to multiple spool holders such as those shown by Mariani (U.S. Pat. No. 3,502,252); Plummer, III (U.S. Pat. No. 4,252,258); and Wirth (U.S. Pat. No. 4,493,446). The patents of Holtan (U.S. Pat. No. 3,508,692); Oakes (U.S. Pat. No. 3,993,230); Pagnini (U.S. Pat. No. 4,130,229); Lien (U.S. Pat. No. 4,648,538); and Ridenour (U.S. Pat. No. 5,065,925) each show various embodiments of tape dispensers. Heil et al. (U.S. Pat. No. 4,915,769) discloses a masking machine whereby masking tape is dispensed onto a surface being masked.

Belt-mounted tape dispensers are shown in each of the references of Yates et al. (U.S. Pat. No. 2,963,208) Littleton (U.S. Pat. No. 4,088,276); Stewart (U.S. Pat. No. 4,105,149); Rankin (U.S. Pat. No. 4,606,485); and Trankle (U.S. Pat. No. 4,880,152). Each of these patents provides certain novel features useful for dispensing a preselected length of tape.

However, in view of the foregoing it would be an advancement in the art to provide a tape dispenser apparatus and method whereby the tape dispenser is removably mountable to a belt, the mounting means for mounting the tape dispenser providing a secure engagement of the tape dispenser to the belt to preclude dislodgment of the tape dispenser when tape is being pulled therefrom. Another advancement in the art would be to provide a tape dispenser that can be easily switched for operation by either the right hand or the left hand. It would also be and advancement in the art to provide a spring-biased cover for shielding the serrated cutter to reduce accidental injuries. Another advancement in the art would be to provide a belt-mountable tape dispenser wherein the placement of the spool of tape relative to the supportive framework is selectively predetermined so as to reduce accidental dislodgment of the tape dispenser from the belt by the forces imposed on the tape during removal and severance of the tape from the tape dispenser. Such a novel tape dispenser apparatus and method is disclosed and claimed herein.

BRIEF SUMMARY AND OBJECTS OF THE INVENTION

This invention is a tape dispenser apparatus and method wherein the tape dispenser is removably mountable to a belt. The tape dispenser includes a curvilinear frame that generally conforms to the external profile of the waist of the wearer. The curvilinear frame has a belt clip at each end for removably mounting the curvilinear frame to the belt. A tape reel is rotatably mounted to a strut extending downwardly from the midpoint of the curvilinear frame. The tape reel is placed below the belt-mounted curvilinear frame so that the pulling forces imposed on the tape will not dislodge the curvilinear frame from the belt. The curvilinear frame, the spaced belt clips, and the placement of the tape reel relative to the cutter assembly provides the stabilizing mechanism for holding the tape dispenser to the belt particularly while tape is being pulled therefrom. A cutter assembly for the tape dispenser is configured to be selectively oriented for operation by either the right hand or the left hand. A spring-biased shield is mounted to the strut and provides a shield for the cutter to guard against accidental contact by the hand of the user.

It is, therefore, a primary object of this invention to provide improvements in belt-mounted tape dispensers.

Another object of this invention is to provide improvements in the method of dispensing tape from a belt-mounted tape dispenser.

Another object of this invention is to provide a tape dispenser having a curvilinear framework to which the tape reel and the cutter assembly are mounted, the curvilinear framework having clips adjacent each end for removably mounting the tape dispenser to a belt.

Another object of this invention is to provide a belt-mounted tape dispenser wherein the spool of tape is supported below the belt-mountable framework so as to direct both the tape removal forces and the cutting forces in a direction that reduces the likelihood of dislodgement of the tape dispenser from the belt upon imposition of these forces.

Another object of this invention is to provide a tape dispenser with a spring-biased shield over the cutter portion of the cutter assembly.

These and other objects and features of the present invention will become more readily apparent from the following description and the accompanying drawings taken in conjunction with the appended claims.

DETAILED DESCRIPTION OF THE INVENTION

Figure 1:
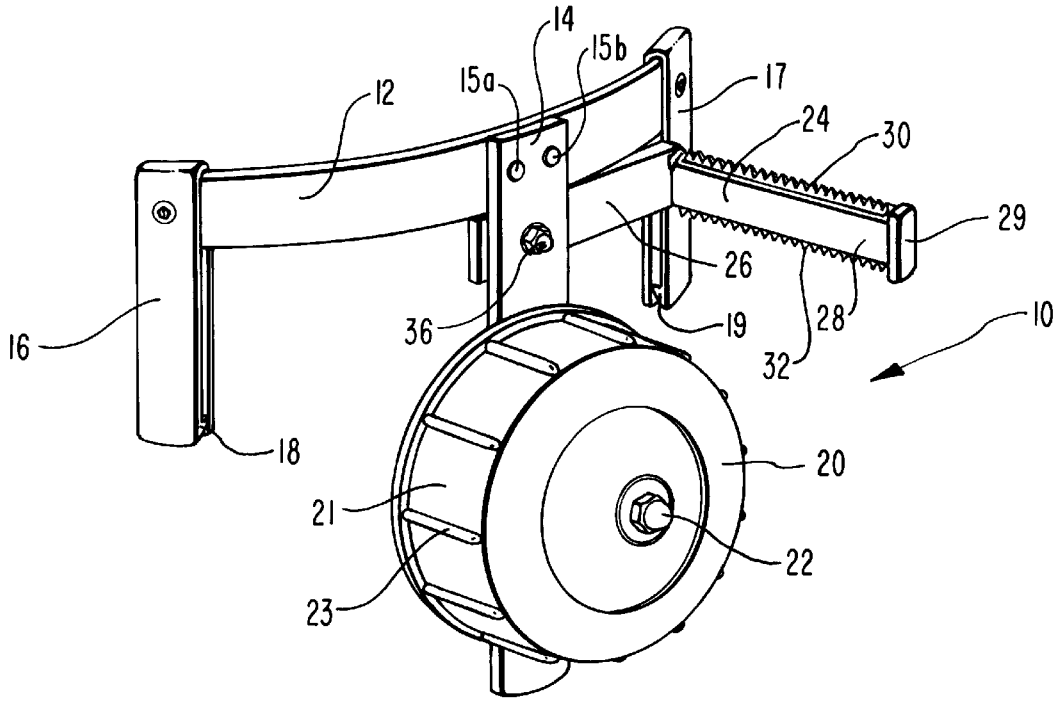
FIG. 1 is a perspective view of the novel, belt-mountable tape dispenser of this invention shown in the absence of the spring-biased shield for the cutter assembly which is shown in FIG. 4.

The invention is best understood from the following description and the appended claims taken in conjunction with the accompanying drawing wherein like parts are designated by like numerals throughout.

General Discussion

The novel tape dispenser of this invention is configured with a curvilinear frame. The frame is fabricated with a predetermined curvature or from a malleable material such as aluminum which can be conformed generally to the waist of the person wearing the tape dispenser. Belt clips are affixed to each end of the curvilinear frame and are used to removably attach the curvilinear frame to the belt of the wearer. The clips are configured with an inverted, elongated, U-shaped configuration and are fabricated from a resilient material such as a plastic, or the like. An inwardly directed detent inside end of each U-shaped clip acts as a retainer to resist the inadvertent dislodgement of the clips and the curvilinear frame from the belt.

A strut is secured to the face of the curvilinear frame and at a midline of the curvilinear frame and extends perpendicularly therefrom. The strut is oriented in a downward direction when the curvilinear frame is mounted to the belt. A reel is rotatably mounted to the strut at a position below the curvilinear frame. The reel releasably supports a spool of tape. Advantageously, the reel is mounted to the strut at a position that holds the spool of tape in such a position that when the tape is pulled from the spool of tape the direction of pull is tangential to the spool of tape and generally parallel to and downwardly against the body of the curvilinear frame. This feature is advantageous in that the pulling forces exerted on the tape are unlikely to dislodge the tape dispenser from the belt. The curvilinear shape of the curvilinear frame also helps hold the curvilinear frame to the belt by placing the clips out of the plane of the reel thus providing an offset against the pulling forces on the tape.

A cutter assembly is mounted to the strut at the juncture between the strut and the curvilinear frame. The cutter assembly includes an arm that extends horizontally from the strut so as to reside at a position generally parallel to the body of the curvilinear frame. One end of the arm has a detent which is secured to the back face of the strut and in abutment against the curvilinear frame. The arm is also provided with a recessed portion and an abutment surface which rests against an edge of the strut. This arrangement provides a mechanism for securely supporting the arm in the horizontal position against both the strut and the curvilinear frame. The cutter bar extends outwardly from the other end of the arm and presents a serrated tape cutter at a position across and below the path of the tape as it is pulled tangentially from the spool. The tape is cut by being pulled downwardly against the serrated tape cutter. A serrated tape cutter is placed on both the upper edge as well as its bottom edge of the cutter bar. These two cutters allow the cutter assembly to be reversed from one side to the other to adapt the tape dispenser for operation by either hand of the user.

Reversal of the cutter assembly for operation by the other hand is accomplished by removal of the arm from the strut, reversal of the cutter assembly, and reattachment of the arm to the strut in its reversed position. In this position, the bottom cutter is now on top and exposed for cutting action as the tape is brought downwardly against the cutter.

A cutter shield is also provided and is fabricated from a sheet metal or a plastic having sufficient resiliency to serve in this function. The cutter shield includes a planar element which extends over the upper cutter and is secured to the strut in conjunction with the arm of the cutter assembly. The cutter shield includes a pair of downwardly directed flanges on each side of the cutter shield, the inside flange adjacent the strut being used to secure the cutter shield to the strut. An ear adjacent the base of the flange engages the reverse edge of the strut to provide an anchor mechanism to inhibit the fixed end of the cutter shield from being rotated. Fixation of the one end of the cutter shield leaves the other end of the cutter shield atop the cutter free to be flexed upwardly, the resistance to such flexure being a function of the stiffness of the cutter shield. Accordingly, the user is able to grasp the tape below the cutter shield and, while flexing the cutter shield upwardly, pull the tape outwardly between the cutter and the cutter shield. The springboard-like effect of the cutter shield allows the free end to be lifted for the passage of the tape incrementally above the cutter as the tape is pulled from the spool of tape. The tape is then pulled downwardly against the cutter to sever the tape at that point.

Reversal of the cutter assembly and the cutter shield is accomplished by removal of these items from the strut and reassembly on the strut in the desired orientation. Either orientation presents the tape in an easily accessible position and readily available for operation by only one hand. Advantageously, the serrated tape cutter is always shielded by the cutter shield regardless of whether the tape dispenser is configured for operation by either the right hand or the left hand.

DETAILED DESCRIPTION

Figure 2:
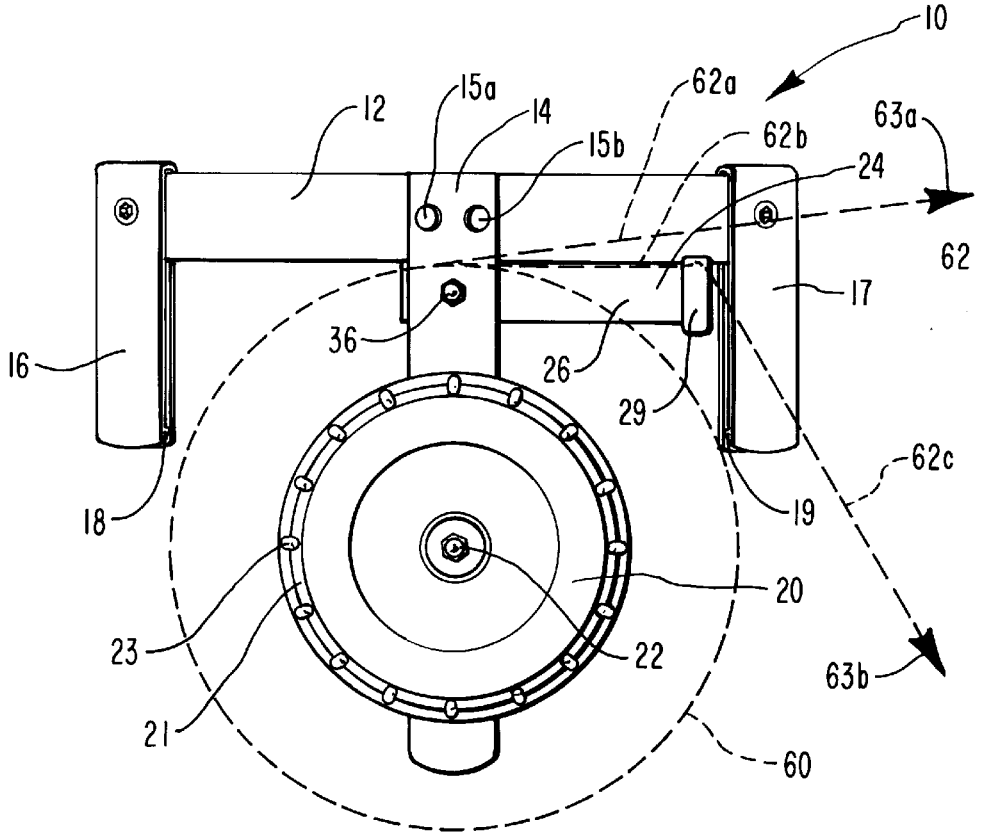
FIG. 2 is a side elevation of the belt-mountable tape dispenser of FIG. 1 schematically showing the force lines exerted on the tape dispenser during pulling and cutting of the tape.

Referring now more particularly to FIGS. 1 and 2, the novel tape dispenser apparatus of this invention is shown generally at 10 and includes a curvilinear frame 12 having a strut 14 mounted adjacent its midpoint and extending perpendicularly downwardly therefrom. Belt clips 16 and 17 are affixed to each end of curvilinear frame 12 and provide the attachment mechanism for releasably mounting tape dispenser 10 to a belt (not shown). A reel 20 is rotatably mounted to strut 14 at an axle 22. A cutter assembly 24 (see also FIG. 3) includes an arm 26 with a cutter bar 28 extending at a right angle therefrom. A pair of serrated tape cutters, upper cutter 30 and a lower cutter 32, are mounted in cutter bar 28.

Curvilinear frame 12 is configured to be worn on a belt (not shown) worn about the waist (not shown) and, therefore, is provided in a curvilinear configuration in order to more closely approximate the external profile of the waist. Curvilinear frame 12 can be produced from a malleable material such as aluminum in order to allow the user (not shown) to mold or otherwise shape curvilinear frame to the waist. The curvature of curvilinear frame 12 is required due to the extended length of curvilinear frame 12. This extended length also provides increased stability to tape dispenser 10 as a tape 62 (shown by dashed lines in FIG. 2) is being removed therefrom as will be discussed more fully hereinafter. The extended length of curvilinear frame 12 also provides sufficient spatial separation between belt clips 16 and 17 which, in turn, provides curvilinear frame 12 with improved stability.

Belt clips 16 and 17 are configured with a narrow, inverted, U-shaped profile to accommodate being directed downwardly over the belt (not shown) to engage the same between the two sides of the U-shaped profile. Inwardly directed detents 18 and 19 on belt clips 16 and 17, respectively, act as detents to provide a releasable engagement mechanism for resisting dislodgment of belt clips 16 and 17 from the belt. Resistance to dislodgement of tape dispenser 10 from the belt is important both during use as well as during periods of nonuse such as when the user is actively engaged in the particular occupation of the user which activity involves movement about other equipment, structures, and the like, where tape dispenser 10 could become inadvertently snagged and thereby dislodged.

Strut 14 is rigidly secured to the outside surface of curvilinear frame 12 by a pair of rivets 15*a* and 15*b*. Rivets 15*a* and 15*b* prevent strut 14 from becoming angularly offset relative to curvilinear frame 12. The placement of strut 14 on the outer surface of curvilinear frame 12 accommodates arm 26 being mounted on the back surface of strut 14 and in abutment against curvilinear frame 12. Additional support for arm 26 is provided by an abutment 27 (FIG. 3) formed in arm 26 by the creation of a recess 25 therein. It is this abutment relationship of arm 26 against curvilinear frame 12 and strut 14 that provides arm 26 with the necessary support against the downward cutting forces imposed on cutter 30 as will be described more fully hereinafter.

Figure 3:
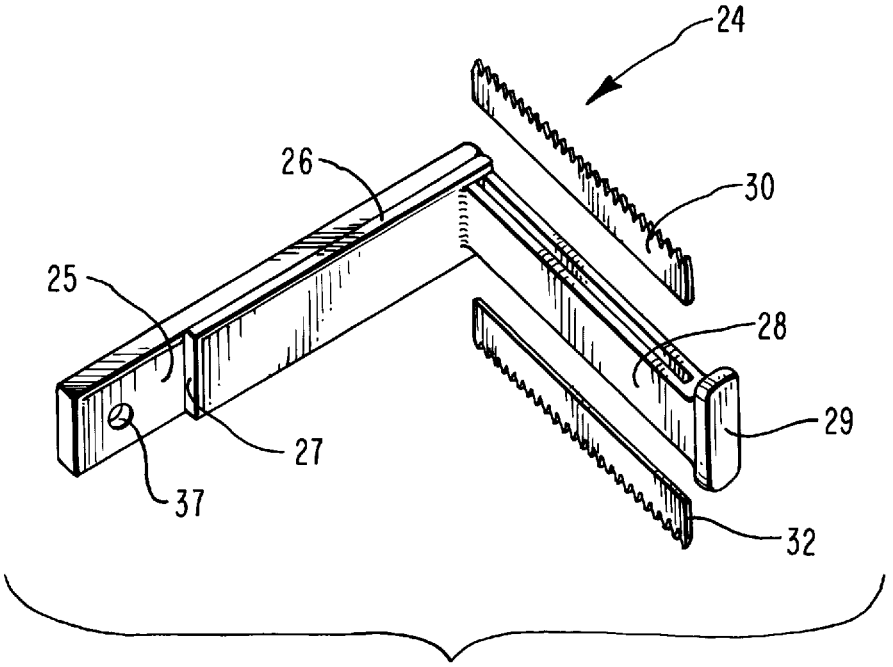
FIG. 3 is an exploded, perspective view of one preferred embodiment of the cutter assembly.

Referring now also to FIG. 3, the cutter assembly for tape dispenser 10 is shown herein generally at 24 and includes an arm 26 having a cutter bar 28 extending perpendicularly therefrom. Arm 26 includes recess 25 which is designed to be placed against the back surface of strut 14. The edge of recess 25 forms abutment surface 27 which is brought into abutment against the corresponding edge of strut 14. A hole 37 in arm 26 in the center of recess 25 provides the attachment mechanism for bolting arm 26 to strut 14. Cutter bar 28 terminates outwardly in an enlarged foot 29 which helps to conceal the ends of cutters 30 and 32 embedded in opposing edges of cutter bar 28. Alternatively, cutter bar 28 with cutters 30 and 32 can be fabricated entirely from the same material, such as a suitable plastic or a metal such as aluminum, thereby providing cutter assembly 24 as a one-piece item.

As shown in FIGS. 1 and 2, arm 26 is assembled to strut 14 in a configuration for use by the right hand of the user. However and advantageously, arm 26 is releasably secured to strut 14 by a bolt 36 which can be removed to allow arm 26 to be reversed for left-hand operation of tape dispenser 10. Specifically, instead of extending to the right as shown in FIGS. 1 and 2, arm 26 can be extended to the left in a position such that cutter 32 is directed upwardly while cutter 30 is directed downwardly.

Figure 4:
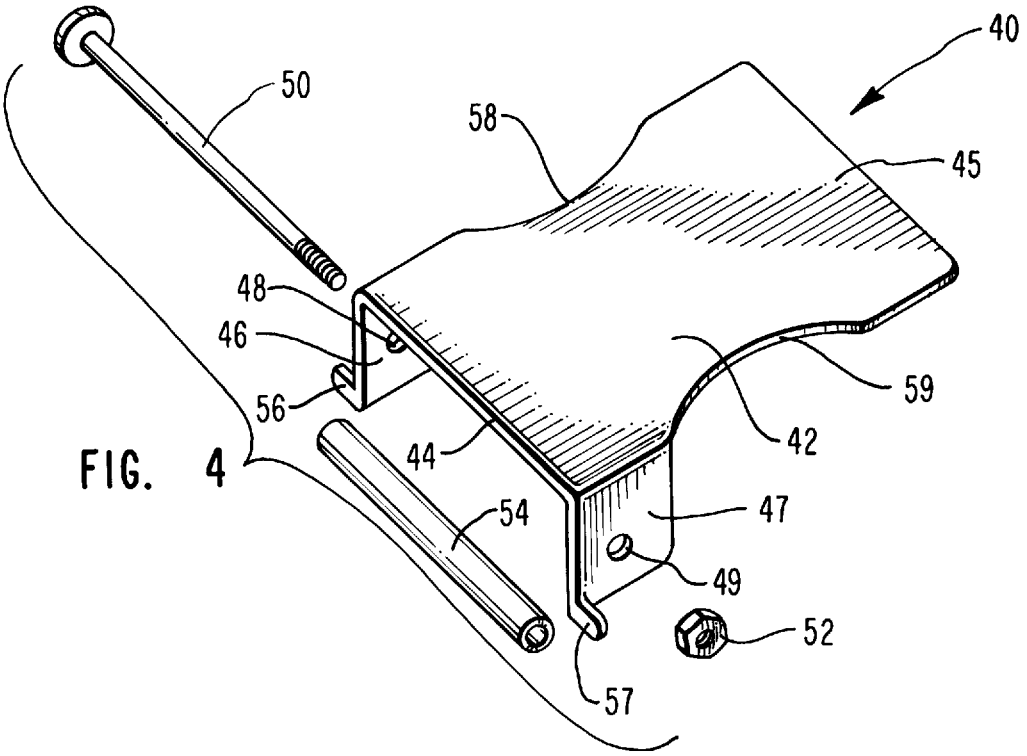
FIG. 4 is an exploded, perspective view of the spring-biased shield assembly for the cutter.

Referring now to FIG. 4, a cutter shield for tape dispenser 10 is shown generally at 40 and includes a shield 42 having a first or fixed end 44 and a second or free end 45. Fixed end 44 is characterized by a pair of downwardly depending flanges 46 and 47 having holes 48 and 49 therethrough, respectively. An elongated bolt 50 and a corresponding nut 52 provide the attachment means for securing cutter shield 40 to strut 14 (FIGS. 1 and 2). Specifically, bolt 50 replaces bolt 36 so that while arm 26 is mounted behind strut 14 flange 46 is placed in front of strut 14 with bolt 50 passing sequentially through arm 26, strut 14 and flanges 46 and 47. A spacer 54 is also provided and is configured as a hollow tube through which bolt 50 passes. The length of spacer 54 is coordinated with the distance between flange 46 and flange 47 so as to rigidly support flanges 46 and 47 against becoming bent inwardly as nut 52 is tightened on bolt 50. A pair of ears 56 and 57 extend outwardly from flanges 46 and 47, respectively, and engage the respective edge of strut 14. For example, with cutter shield 40 mounted to tape dispenser 10 (FIGS. 1 and 2) with arm 26 extending to the right, flange 46 will be placed against strut 14 with ear 56 engaging strut 14 below the end of arm 26. Ear 56 is thus able to support flange 46 from being rotated counter clockwise when free end 45 of shield 42 is free to be flexed upwardly in order to pass tape 62 from reel 20 between cutter shield 40 and cutter 30. A pair of cutouts 58 and 59 in shield 42 provide ready access to the underlying tape 62 when cutter shield 40 is mounted to tape dispenser 10.

Reversal of cutter assembly 24 is accompanied by a corresponding reversal of cutter shield 40. Specifically, with arm 26 switched to the left and with cutter 32 on the upper face of cutter bar 28, flange 47 is placed against strut 14 while ear 59 is engaged against the edge of strut 14. Bolt 50 is then passed sequentially through arm 26, strut 14, flange 47, spacer 54, and flange 46 where it is secured by nut 52. In this orientation cutout 58 is now on the outside and provides access to the underlying tape 62.

Referring now more specifically to FIG. 2, a spool of tape is shown schematically by a dashed outline at spool 60 and is mounted to reel 20. Reel 20 is any suitable, conventional reel having an open face over which spool 60 can be placed. Specifically, reel 20 is a conventional tape reel and is configured as wheel having a rim 21 with a plurality of transverse ribs 23 protruding outwardly therefrom to form an engagement mechanism for releasable engagement with the internal surface of spool 60. The surface of rim 21 is configured with a slight frusto-conical contour to accommodate a tight press-fit relationship between ribs 23 of reel 20 and the internal diameter of spool 60.

Spool 60 carries tape 62 which is pulled from spool 60 and above cutter assembly 24 as shown schematically by arrow 63*a*. This position of tape 62 is shown by dashed line 62*a*. When it is time to cut tape 62 it is brought downwardly into contact with cutter 30 (FIG. 1) as shown by dashed line 62*b*. Continued downward pulling of tape 62 as shown by arrow 63*b* results in tape 62 being severed to produce the predetermined length of tape 62 as shown by dashed lines 62*c*.

It is important to note that the entire sequence described hereinbefore whereby tape 62 is pulled from spool 60 and cut by cutter 30 (FIGS. 1 and 3) is accomplished with only one hand. Specifically, upon grasping tape 62*b* (the remnant of tape 62 left behind and attached between spool 60 and cutter 30) cutter shield 42 (FIG. 4) is resiliently urged upwardly so that free end 45 is raised above cutter 30. Continued pulling of tape 62 (arrow 63*a* and tape 62*a*) passes tape 62 above cutter 30 while free end 45 of cutter shield 42 rests against the back of tape 62 as it is reeled from spool 60. The downward pulling force on tape 62 (arrow 63*b*) severs tape 62 with cutter 30 to produce tape 62*c* thereby again leaving tape 62*b* stretched between cutter 30 and spool 60 while cutter shield 42 again rests atop tape 62*b*. Tape 62*c* is then free to be used for its intended purpose and tape dispenser 10 is again ready to be used to dispense another length of tape 62*c*.

Advantageously, the foregoing sequence is not only accomplished using one hand, but the forces imposed on tape dispenser 10 are such that they do not dislodge tape dispenser 10 from the belt. Specifically, the pulling force represented by arrow 63*a* is generally parallel to the longitudinal orientation of curvilinear frame 12. Further, curvilinear frame 12 is mounted in a curvilinear configuration to the belt so that the force of arrow 63*a* is applied tangentially to the curvature of curvilinear frame 12. This means that belt clips 16 and 17 are more readily able to hold curvilinear frame 12 in place on the belt.

The downward pulling forces represented by arrow 63*b* are directed downwardly tending to seat belt clip 17 more firmly against the belt. Also, the fulcrum for the pulling force of both arrows 63*a* and 63*b* is below the plane of curvilinear frame 12 so that there is a significant reduction in any lifting force that may or may not be imposed on belt clip 16.

The Method

The method of this invention is practiced by the user (not shown) releasably mounting tape dispenser 10 to his or her belt (not shown) with belt clips 16 and 17 releasably securing tape dispenser 10 to the belt. Detents 18 and 19 on belt clips 16 and 17, respectively, help hold belt clips 16 and 17 in place on the belt.

Arm 26 is mounted to strut 14 for operation by either the right hand as shown in FIGS. 1 and 2 or for the left hand. Advantageously, cutter shield 40 can be mounted to strut 14 to serve as a protective shield against accidental injury from either cutter 30 (right hand configuration as shown) or cutter 32 (left hand configuration, not shown). Cutter shield 40 uses bolt 50 and nut 52 along with spacer 54 in order to become mounted to strut 14. Bolt 50 is also used to mount arm 26 to strut 14.

Spool 60 of tape 62 is mounted to reel 20 with tape 62 extending underneath cutter shield 42 and across cutter 30. In this manner, tape 62 is readily accessible while at the same time cutter 30 is shielded by cutter shield assembly 40 to preclude accidental injury by the same. Advantageously, the user is readily able to grasp tape 62*b* under cutter shield 42 and pull it outwardly so that it passes between cutter 30 and cutter shield 42 until the desired length of tape 62*a* has been unreeled from spool 60. A sharp downward pull (arrow 63*b*) causes cutter 30 to sever tape 62 leaving tape 62*b* releasably adhered to cutter 30 and, therefore, readily available to be pulled outwardly again. In the meantime, tape 62*c* is available to be used as desired.

From the foregoing it is readily apparent that tape dispenser 10 provides convenient, safe, single hand operation for dispensing tape 62*c* from spool 60 while, simultaneously, holding spool 60 securely to the belt. Removal of tape dispenser 10 from the belt is accomplished by the user simply spreading apart the resilient arms of belt clips 16 and 17 to allow detents 18 and 19, respectively, to clear the belt and thus complete the removal of tape dispenser 10 from the belt.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for providing access to a spool of tape for retrieval by one hand comprising the steps of:

fabricating a tape dispenser having a frame fabricated from a malleable material and having a belt clip at each end of said frame and a downwardly depending strut affixed to said frame, said strut including a reel rotatably mounted to said strut below said frame, said strut including a cutter assembly and a cutter shield mounted to said strut;

conforming said frame to the waist of a wearer;

releasably mounting said belt clips to a belt worn about the waist of the wearer;

placing a spool of tape on said reel and extending tape from the spool of tape between said cutter assembly and said cutter shield; and retrieving tape from said tape dispenser by lifting said cutter shield while pulling the tape with one hand outwardly beyond said cutter assembly; and cutting the tape by pulling the tape downwardly against said cutter assembly with the one hand thereby severing the tape with said cutter assembly.

2. The method defined in claim 1 wherein said fabricating step comprises selectively mounting said cutter assembly and said cutter shield to accommodate one of right hand operation and left hand operation.

3. The method defined in claim 2 wherein said mounting step includes bracing said cutter assembly with said frame thereby supporting said cutter assembly on said strut.

4. The method defined in claim 1 wherein said retrieving step includes lifting an end of said cutter shield while grasping the tape.

* * * * *